US011319942B2

(12) United States Patent
Lin et al.

(10) Patent No.: US 11,319,942 B2
(45) Date of Patent: May 3, 2022

(54) COMPRESSOR HAVING HEAT DISSIPATING STRUCTURE

(71) Applicants: Yu-Wen Lin, Chiayi County (TW); Shi-An Sun, Taichung (TW)

(72) Inventors: Yu-Wen Lin, Chiayi County (TW); Shi-An Sun, Taichung (TW)

( * ) Notice: Subject to any disclaimer, the term of this patent is extended or adjusted under 35 U.S.C. 154(b) by 188 days.

(21) Appl. No.: 16/517,532

(22) Filed: Jul. 19, 2019

(65) Prior Publication Data

US 2021/0017974 A1 Jan. 21, 2021

(51) Int. Cl.
*F04B 39/06* (2006.01)

(52) U.S. Cl.
CPC ..... *F04B 39/066* (2013.01)

(58) Field of Classification Search
CPC ..... F04B 39/066; F04B 39/121; F04B 35/04; F04B 35/01; F04B 27/005; F04B 27/0536
See application file for complete search history.

(56) References Cited

U.S. PATENT DOCUMENTS 2,981,462 A * 4/1961 Niedermayer ..... F16K 15/141 137/512.1
2019/0154024 A1* 5/2019 De Keyser ..... F04B 49/20

FOREIGN PATENT DOCUMENTS

CN 108869238 A * 11/2018
GB 2314593 A * 1/1998 ..... F04B 35/04

* cited by examiner

*Primary Examiner* — Charles G Freay

(57) ABSTRACT

A compressor includes a motor body having a gas compressing motor, at least a pneumatic cylinder for compressing gas, and at least a cooling fan. The pneumatic cylinder comprises a cylinder support arranged on top of the compressing motor, a valve panel arranged on top of the cylinder support, a cylinder cover provided on top of the valve panel, and a piston connecting rod body slidably connected with the cylinder support. The heat dissipating channels, the gas channels, and the heat dissipating passages are arranged in series to jointly form a heat dissipation path, such that when the piston connecting rod body is driven by the compressing motor to conduct a gas compressing process in the cylinder support, the cooling fan is also driven to operate to drive the external gas to flow through the heat dissipation path and to flow out, so as to bring out the heat produced during the operation of the pneumatic cylinder and to achieve an effective heat dissipation.

4 Claims, 5 Drawing Sheets

COMPRESSOR HAVING HEAT DISSIPATING STRUCTURE

BACKGROUND OF THE PRESENT INVENTION

Field of Invention

The present invention relates to a compressor, and more particularly to a compressor having a heat dissipation path arranged on the pneumatic cylinder thereof.

Description of Related Arts

Currently, there are two major types of compressor, which are the general type and the high-speed type. General type has lower operation speed and mainly relies on a plurality of heat dissipation fins arranged on the pneumatic cylinder as its heat dissipation mechanism for cooling and allowing the compressor to continuously operate. Relative technologies include the prior arts disclosed in Taiwan Pat. Nos. 094202857, 095200952, 095218837, and etc. In order to further enhance the heat dissipation function of the compressor, some technologies include adding internal cooling fan to cool the driving motor, but keeping use the pneumatic cylinder heat dissipation fin mechanism on the pneumatic cylinder. These prior arts include technologies disclosed by Taiwan Pat. Nos. 80207381, 090203389, 096203128, 105217577, and etc. Unfortunately, these conventional practices can only provide limited heat dissipation ability to the pneumatic cylinder, which may render overheat and decrease of performance of the operating pneumatic cylinder. Accordingly, some practitioners decided to add a cooling device outside the pneumatic cylinder of the pneumatic cylinder. For example, technology disclosed in Taiwan Pat. No. 101102543 adds a set of cooling fan on the exterior of the pneumatic cylinder. Although such practice does help on the heat dissipation of the pneumatic cylinder, it greatly increases the manufacturing cost of the entire compressor, that is still not an ideal design. Hence, substantially, there has not been an ideal heat dissipation mechanism in the technical field of compressor.

Besides, some other heat dissipation technologies are listed here for reference, including the technologies disclosed by Taiwan Pat. Nos. 104105158, 104100602, and 104200322. Even though the heat dissipation mechanism of a motor could be somehow different from that of the pneumatic cylinder of a compressor.

SUMMARY OF THE PRESENT INVENTION

An object of the present invention is to provide a compressor that has a better heat dissipation ability.

Accordingly, the present invention provides a compressor which comprises a compressing motor, at least a pneumatic cylinder for compressing gas, and at least a cooling fan. The pneumatic cylinder comprises a cylinder support arranged on top of the compressing motor, a valve panel arranged on top of the cylinder support, a cylinder cover provided on top of the valve panel, and a piston connecting rod body slidably connected with the cylinder support. The cylinder support has a compression space formed and provided in a middle portion thereof for accommodating the piston connecting rod body, and a plurality of heat dissipating channels provided around the compression space. The valve panel provides a plurality of gas channels corresponding to the heat dissipating channels. The cylinder cover provides a plurality of heat dissipating passages corresponding to the heat dissipating channels and the gas channels. The heat dissipating channels, the gas channels, and the heat dissipating passages are arranged in series to jointly form a heat dissipation path, such that when the piston connecting rod body is driven by the compressing motor to conduct a gas compressing operation in the cylinder support, the cooling fan will also be driven to operate to drive the external gas to flow through the heat dissipation path that is jointly formed by the heat dissipating channels of the cylinder support, the gas channels of the valve panel, and the heat dissipating passages of the cylinder cover and to flow out. As a result, heat produced during the operation of the pneumatic cylinder can be transferred out to achieve an effective heat dissipation effect. The arrangement of the heat dissipation path enables a better heat dissipation function without additional parts or substantial changing the design of the mechanism, which allows the manufacturing cost of the compressor remaining under control.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
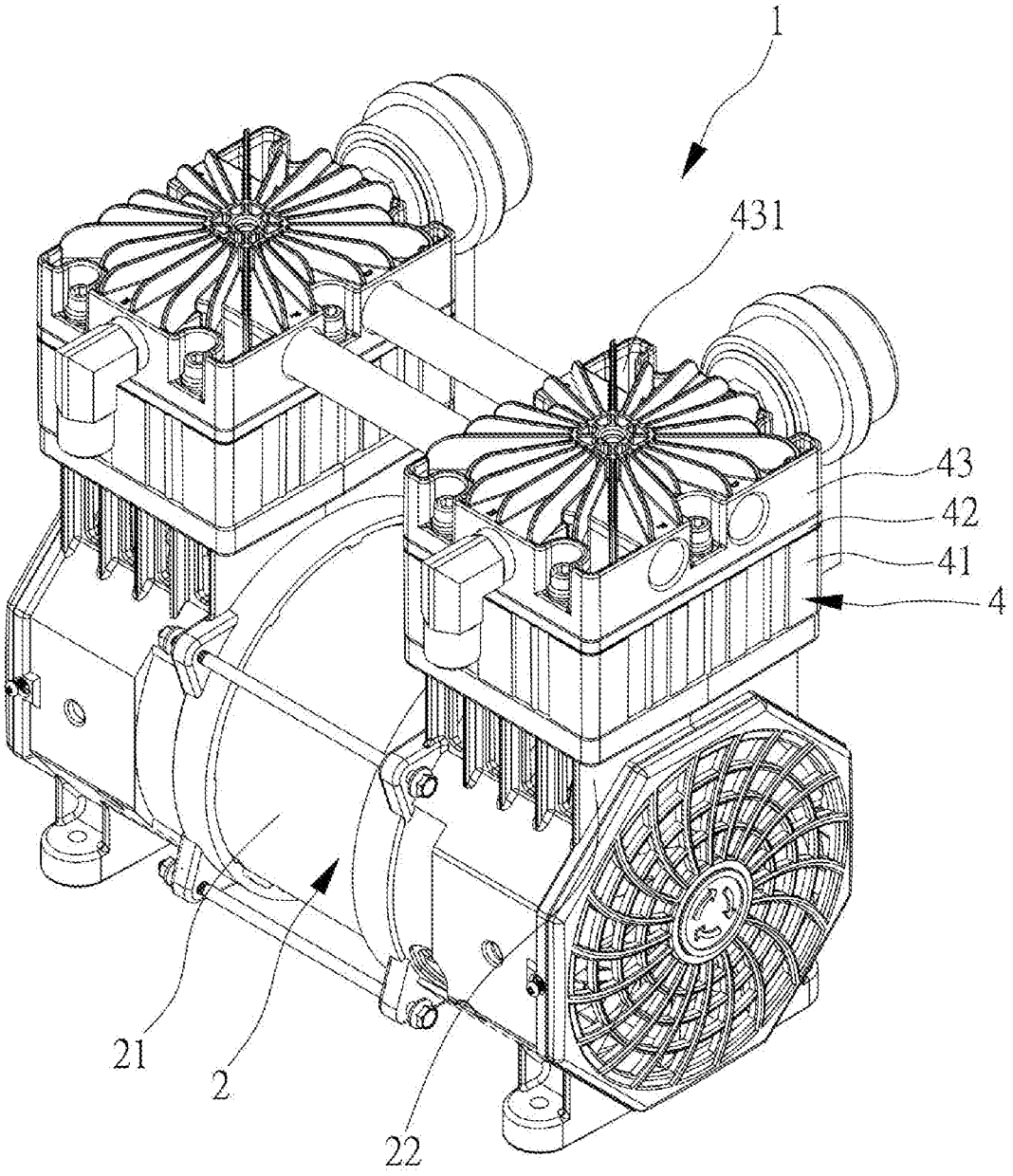
FIG. 1 is a perspective view of a compressor according to a preferred embodiment of the present invention.
Figure 2:
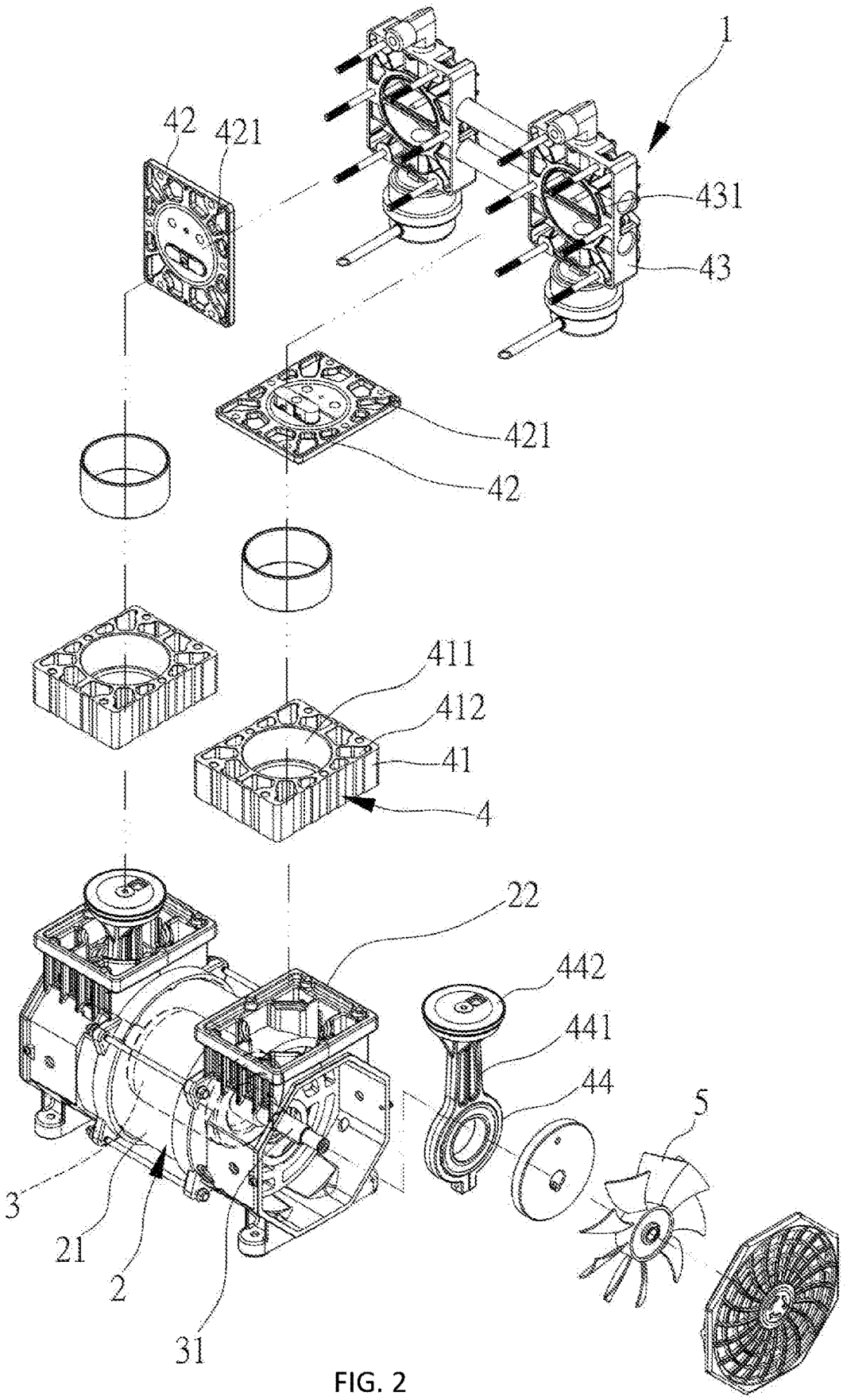
FIG. 2 is a partial exploded view of the compressor according to the above preferred embodiment of the present invention.
Figure 3:
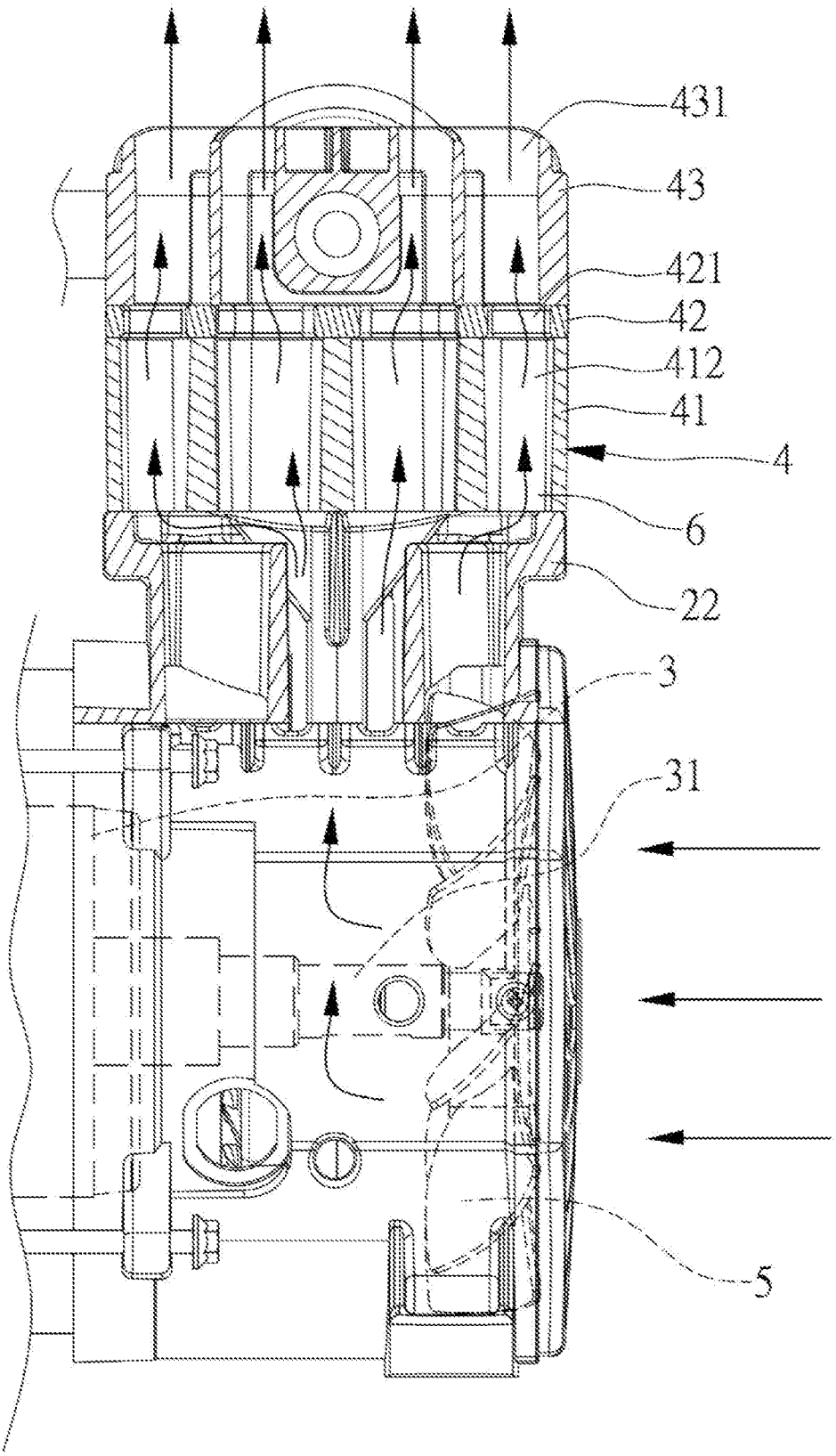
FIG. 3 is a partial sectional view of the compressor according to the above preferred embodiment of the present invention.
Figure 4:
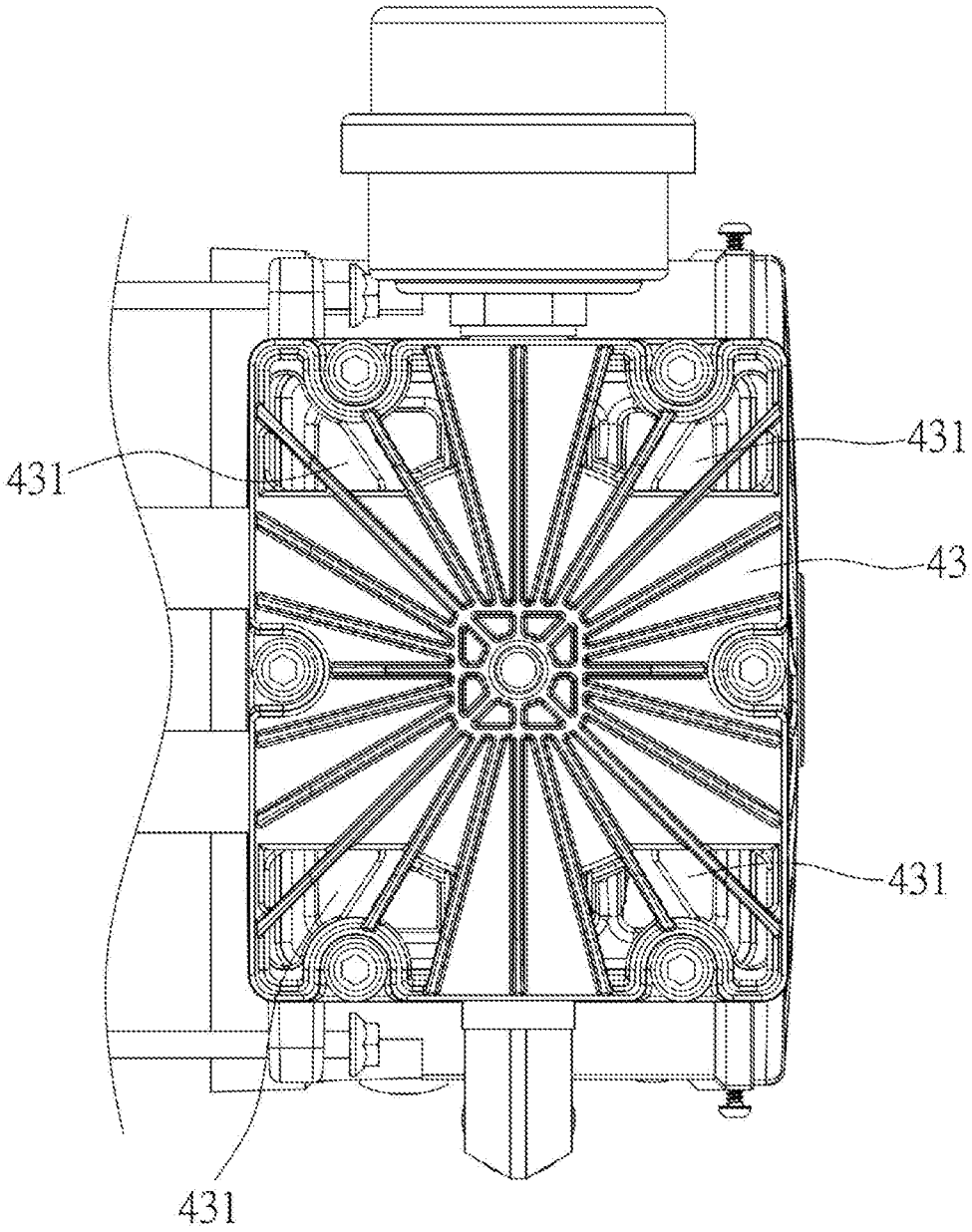
FIG. 4 is a partial top view of the compressor according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1-4, the compressor 1 according to a preferred embodiment of the present invention is adapted for compressing air. The compressor 1 comprises a motor body 2 having a motor 3 disposed therein, at least one pneumatic cylinder 4 adapted for compressing gas, and at least one cooling fan 5. The motor body 2 comprises a motor shell 21 and two crank houses 22 respectively communicated to and extended from two top ends of the motor shell 21. The motor 3 is arranged in the motor shell 21 of the motor body 2 and has a motor shaft 31. Two ends of the motor shaft 31 are respectively protruded from two ends of the motor shell 21, whereas only one of the ends of the motor shaft 31 is shown in the drawings. The quantities of the pneumatic cylinder 4 and the cooling fan 5 are both embodied as two. Each of the pneumatic cylinders 4 has a cylinder support 41 overlappedly arranged on the respective crank house 22, a valve panel 42 arranged on top of the cylinder support 41, a cylinder cover 43 arranged on top of the valve panel 42, and a piston connecting rod body 44 slidably connected with the cylinder support 41. The cylinder support 41 has a compression space 411 formed and provided in a middle portion thereof for accommodating the piston connecting rod body 44 and a plurality of heat dissipating channels 412 respectively provided around the compression space 411. The valve panel 42 provides a plurality of gas channels 421 corresponding to the heat dissipating channels 412 of the cylinder support 41. The cylinder cover 43 provides a plurality of heat dissipating passages 431 corresponding to the heat dissipating channels 412 and the gas channels 421. The heat dissipating channels 412, the gas channels 421, and the heat dissipating passages 431 are arranged in series to jointly form a heat dissipation path 6, wherein the heat dissipation path 6 is communicating with the crank houses 22. The two ends of the motor shaft 31 of the motor 3 are extended from inside outwardly to respectively couple with the piston connecting rod bodies 44 of the pneumatic cylinders 4 and the cooling fans 5 arranged thereon. Each piston connecting rod body 44 comprises a connecting rod 441 axially coupled with the motor shaft 31 and a piston 442 arranged to slide in an interior of the cylinder support 41.

During the operation of the compressor 1, the motor shaft 31 rotated by the motor 3 will drive the connecting rods 441 and the cooling fans 5 coupled on the two ends thereof to run. At this moment, the pistons 442 which are driven respectively by the connecting rods 441 to move reciprocately in the cylinder supports 41 respectively to compress gas. Meanwhile, the cooling fans 5 bring external gas such as air to flow into the crank houses 22 through the heat dissipating channels 412 of the cylinder supports 41, as illustrated in the arrow direction in FIG. 3, and flow out through the heat dissipation path 6 formed by the heat dissipating channels 412 of the cylinder supports 41, the gas channels 421 of the valve panels 42 and the heat dissipating passages 431 of the cylinder covers 43. Because the external gas (such as air) passes through the cylinder supports 41, the valve panels and the cylinder covers 43, it can bring the heat generated during the operation of the pneumatic cylinder 4 to outside, so as to achieve heat dissipation effectively. This configuration of heat dissipation path 6 enables a better heat dissipation result without additional parts or substantial changing of the structure of the compressor, which effectively controls the manufacturing cost of the compressor 1.

Figure 5:
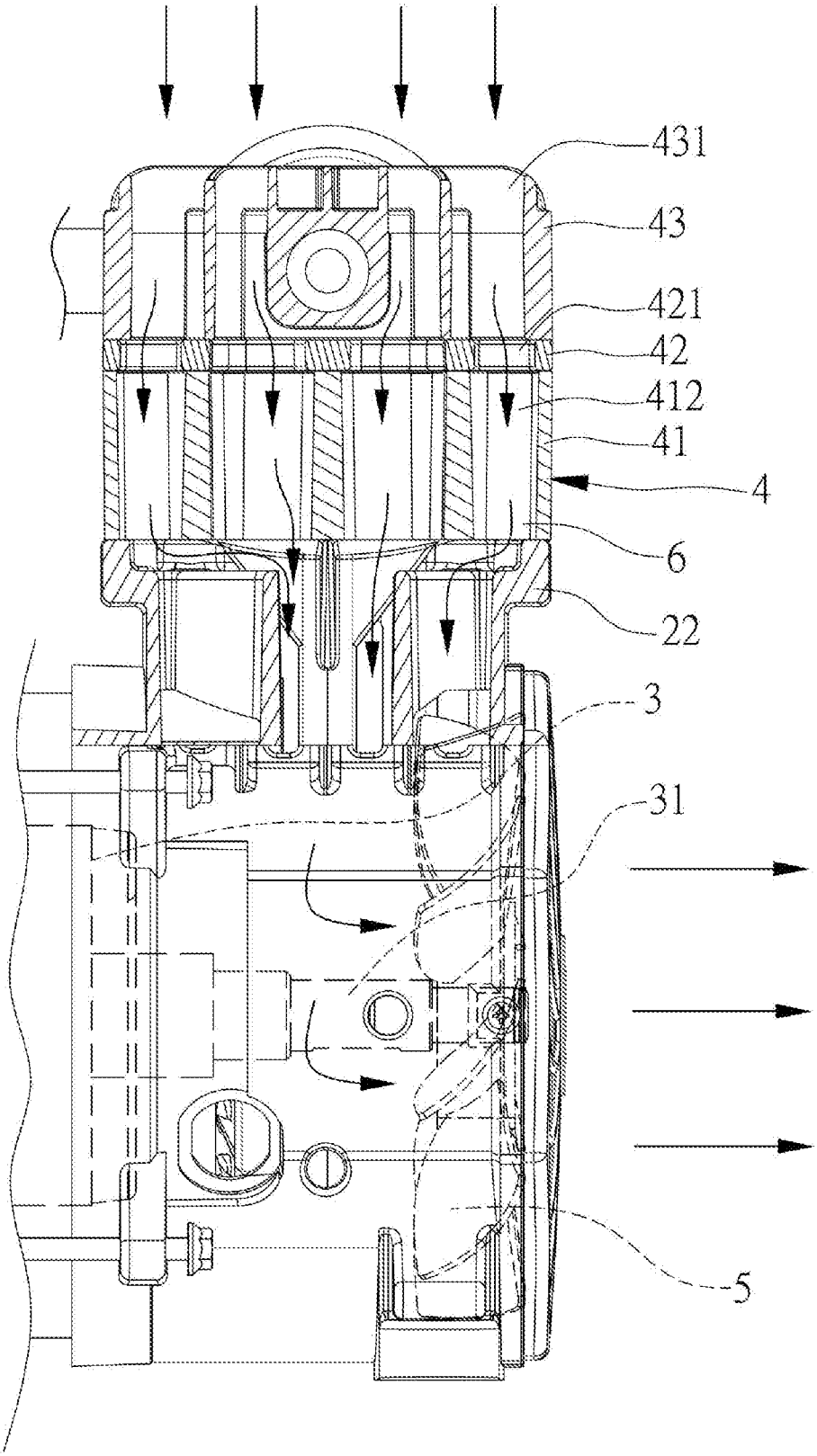
FIG. 5 is a partial sectional view of the compressor according to the above preferred embodiment of the present invention.

In addition, it is worth mentioning that, the design of the compressing motor 3 of the compressor 1 according to the present invention allows both forward and backward rotations. For instance, on one hand, when the motor 3 rotates forward, it can drive the cooling fans 5, as mentioned above, to inhale the external air to flow out through the heat dissipation path 6 for heat dissipation, as illustrated in the arrow direction in FIG. 3. On the other hand, based on the user's needs, the motor 3 may also rotate backward to backwardly rotate the motor shaft 31 thereof, so as to drive the cooling fan 5 to rotate reversely to inhale the external air to flow out through the heat dissipation path 6 as illustrated in the arrow direction in FIG. 5. Then the air is discharged through the cooling fans 5 in the crank houses 22 to outside that brings out the heat generated during the operation of the motor 3 at the same time, which also provides heat dissipation for the pneumatic cylinders 4 and the motor 3.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A compressor, comprising:

a motor body, at least one pneumatic cylinder for compressing gas, and at least one cooling fan, wherein said at least one pneumatic cylinder comprises a cylinder support arranged on top of said motor body, a valve panel arranged on top of said cylinder support, a cylinder cover provided on top of said valve panel, and a piston connecting rod body slidably connected with said cylinder support, wherein said cylinder support has a compression space formed and provided in a middle portion thereof for accommodating said piston connecting rod body and a plurality of heat dissipating channels provided around said compression space, wherein said valve panel provides a plurality of gas channels corresponding to said heat dissipating channels, wherein said cylinder cover provides a plurality of heat dissipating passages corresponding to said heat dissipating channels and said gas channels, wherein said heat dissipating channels, said gas channels, and said heat dissipating passages are arranged in series to jointly form a heat dissipation vertical path, such that when said piston connecting rod body is driven by said motor body to conduct a gas compressing operation in said cylinder support, said cooling fan is also driven to operate to force external gas to flow through said heat dissipation vertical path jointly formed by said heat dissipating channels of said cylinder support, said gas channels of said valve panel, and said heat dissipating passages of said cylinder cover, wherein the external gas flows vertically out from said heat dissipating passages at a top of said cylinder cover.

2. The compressor, as recited in claim 1, wherein said motor body comprises a motor, a motor shell having a first top end, and at least one crank house communicated to and extended from said first top end of said motor shell, wherein said cylinder support of said pneumatic cylinder is overlappedly arranged on said crank house, wherein said heat dissipation path is connected with said crank house.

3. The compressor, as recited in claim 2, wherein said motor is arranged in said motor shell of said motor body and has a motor shaft, wherein said piston connecting rod body and said cooling fan are respectively arranged on said motor shaft, wherein said piston connecting rod body has a connecting rod axially disposed on said motor shaft and a piston slidably arranged in said cylinder support, such that when said motor shaft rotates, said piston is driven to compress gas in said cylinder support and said cooling fan is driven to bring an external gas into said crank house and to discharge the external gas through said heat dissipation path.

4. The compressor, as recited in claim 3, wherein two said cooling fans and two said pneumatic cylinders are provided, wherein said two cooling fans and said two pneumatic cylinders are respectively disposed at two sides of said motor shell of said motor body, wherein said motor body comprises two said crank houses and said motor shell has a second top end, wherein said two crank houses are provided and respectively communicated to and extended from said first and second top ends of said motor shell and said pneumatic cylinders are respectively arranged on said two crank houses, wherein two ends of said motor shaft of said motor respectively drive said two cooling fans and said two piston connecting rod bodies of said pneumatic cylinders to operate.

* * * * *